US009207017B2

(12) United States Patent
Zaiser et al.

(10) Patent No.: US 9,207,017 B2
(45) Date of Patent: Dec. 8, 2015

(54) FLUID DIFFUSING NOZZLE DESIGN

(71) Applicant: Hydro-Thermal Corporation, Waukesha, WI (US)

(72) Inventors: James Zaiser, Elm Grove, WI (US); Lee Richard Van Dixhorn, West Allis, WI (US); Kurt R. Schreib, Mukwonago, WI (US); Robert Bourdo, II, Oak Creek, WI (US); Vineet Barot, Milwaukee, WI (US)

(73) Assignee: Hydro-Thermal Corporation, Waukesha, WI (US)

( * ) Notice: Subject to any disclaimer, the term of this patent is extended or adjusted under 35 U.S.C. 154(b) by 124 days.

(21) Appl. No.: 13/867,625

(22) Filed: Apr. 22, 2013

(65) Prior Publication Data

US 2014/0138860 A1 May 22, 2014

Related U.S. Application Data

(60) Provisional application No. 61/637,104, filed on Apr. 23, 2012.

(51) Int. Cl.
*B01F 3/04* (2006.01)
*F28C 3/08* (2006.01)
(Continued)

(52) U.S. Cl.
CPC ..... *F28C 3/08* (2013.01); *B01F 3/04099* (2013.01); *B01F 3/04248* (2013.01); *B01F 5/0463* (2013.01); *B01F 15/0261* (2013.01);
(Continued)

(58) Field of Classification Search
CPC .... B01F 3/04; B01F 3/04099; B01F 3/04241; B01F 3/04248; B01F 2003/04354; B01F 2003/04361; B01F 2003/04368
USPC ..... 261/76, 78.2, DIG. 10; 366/160.1
See application file for complete search history.

(56) References Cited

U.S. PATENT DOCUMENTS 1,762,313 A 6/1930 Snow et al.
2,913,232 A 11/1959 Silverman
(Continued)

FOREIGN PATENT DOCUMENTS

DE 3626140 A1 11/1988
DE 29719007 U1 2/1999
(Continued)

OTHER PUBLICATIONS

PCT Search Report dated Aug. 19, 2013.
(Continued)

*Primary Examiner* — Robert A Hopkins
(74) *Attorney, Agent, or Firm* — Andrus Intellectual Property Law, LLP

(57) ABSTRACT

A nozzle design for diffusing high pressure steam into by flowing process fluid of substantially lower pressure while reducing the noise intensity generated. The injection nozzles include an opening having a first diameter to receive steam and a second diameter to inject the steam into a flow of liquid. The diameters of the first and second openings can vary relative to each other to enhance the flow characteristics of the steam or other gas being injected into a flow of liquid. The outer surface of a diffuser tube is coated with an insulating material, such as plastic. In alternate embodiments, the orientation of the injection holes can be angled either upstream or downstream to further enhance mixing characteristics of the steam.

17 Claims, 8 Drawing Sheets

(51) Int. Cl.

| | |
|---|---|
| ***B01F 5/04*** | (2006.01) |
| ***B01F 15/02*** | (2006.01) |
| ***B01F 15/06*** | (2006.01) |
| ***F28C 3/06*** | (2006.01) |

(52) U.S. Cl.

CPC ..... *B01F15/063* (2013.01); *F28C 3/06* (2013.01); *B01F 2003/04354* (2013.01); *B01F 2015/062* (2013.01); *B01F 2215/0431* (2013.01); *F28F 2265/28* (2013.01); *F28F 2270/00* (2013.01)

(56) References Cited

U.S. PATENT DOCUMENTS

| | | | | |
|---|---|---|---|---|
| 3,246,888 | A | 4/1966 | Jenny | |
| 3,776,278 | A | 12/1973 | Allen | |
| 4,249,574 | A | 2/1981 | Schnall et al. | |
| 4,921,014 | A | 5/1990 | Tartaglia et al. | |
| 5,929,396 | A | 7/1999 | Awad | |
| 6,082,712 | A * | 7/2000 | Cincotta et al. | 261/76 |
| 6,361,025 | B1 | 3/2002 | Cincotta et al. | |
| 6,505,646 | B1 | 1/2003 | Singleton | |
| 6,536,472 | B2 | 3/2003 | Baumann | |
| 6,772,856 | B2 | 8/2004 | Ishii | |
| 7,152,851 | B2 | 12/2006 | Cincotta | |
| 7,549,506 | B2 | 6/2009 | Sattinger | |
| 8,568,017 | B2 * | 10/2013 | Zaiser et al. | 366/160.1 |
| 2004/0222324 | A1 | 11/2004 | Habib et al. | |
| 2012/0199353 | A1 * | 8/2012 | Fermaniuk et al. | 166/305.1 |

FOREIGN PATENT DOCUMENTS

| | | | |
|---|---|---|---|
| EP | 0011763 | A1 | 6/1980 |
| GB | 806267 | A | 12/1958 |
| WO | 9738264 | A1 | 10/1997 |
| WO | 99/22178 | A1 | 5/1999 |

OTHER PUBLICATIONS

English translation of Bucher EP0011763. Nov. 6, 1980.
English translation of Rosenstock DE3626140. Nov. 2, 1988.

* cited by examiner

FLUID DIFFUSING NOZZLE DESIGN

CROSS-REFERENCE TO RELATED APPLICATION

The present application is based on and claims priority to U.S. Provisional Patent Application Ser. No. 61/637,104 filed Apr. 23, 2012.

BACKGROUND

The present disclosure generally relates to direct contact steam injection heater diffusers. More specifically, the present invention relates to a steam injection heater diffuser in which steam is diffused into by flowing process fluid through a plurality of holes having a multi-diameter interior to reduce noise.

In diffusers described in previous direct contact steam injection heater patents, such as U.S. Pat. Nos. 6,361,025 and 7,152,851, steam flows through a plurality of straight walled cylindrical orifices or nozzles having sharp edges. The steam is expelled from the diffuser at high velocity into a process fluid flowing past the diffuser perpendicular to the axis of the orifice or nozzle. Under numerous working conditions, these simple nozzles and orifices work sufficiently well in transferring heat energy from the steam to the process fluid while remaining stable and at a decibel level that is comfortable to the human ear. Under certain conditions, however, instability may develop in the jet of exiting steam, which leads to undesirable high frequency, high decibel noise.

SUMMARY

The present disclosure is to be used in different types of direct contact steam injection type heaters such as those described in U.S. Pat. Nos. 6,361,025 and 7,152,851. The present disclosure is an improvement to a steam diffuser, containing a multiplicity of improved nozzles with the purpose of diffusing steam into by flowing process fluid. The improved diffuser design is comprised of one or more cluster(s) or zones of precisely shaped nozzles. Each cluster or zone is separated vertically by a solid band that is void of nozzles. In addition, each of the individual nozzles in the spaced zones is characterized by uniquely shaped cross sections designed to increase stability in the steam jet across the diffuser.

The injection type heater includes a diffuser tube that has an outer wall that defines an open interior that receives the heated gas. The outer wall of the diffuser tube includes an inner surface and an outer surface. The diffuser tube includes a plurality of nozzles that are spaced along the outer wall of the diffuser tube to direct the heated gas out of the open interior and into the fluid stream that is passing over the outer surface of the outer wall. Each of the nozzles includes an inlet opening in communication with the open interior at the inner surface and an outlet opening in communication with the outer surface of the diffuser tube. The flow of heated gas passes through each of the nozzles to heat the fluid stream.

In one embodiment of the disclosure, each of the nozzles includes a first cylinder having a constant first diameter and a second cylinder having a constant second diameter. The first and second cylinders are joined to each other by a conical transition zone. The first and second cylinders define a first diameter for the inlet opening and a second diameter for the outlet opening where the second diameter is greater than the first diameter. This configuration for the nozzle decreases the noise created by the flow of heated gas through the nozzles.

In a second embodiment of the nozzle design, each nozzle includes a constant diameter first cylinder that defines the inlet opening and has a first diameter. The first cylinder is joined to a conical section that extends from the first cylinder to the outer surface to define the outlet opening. The outlet opening has a second diameter that is greater than the first diameter.

In yet another alternate embodiment of the nozzle design, the nozzle extends between a first diameter inlet opening and a second diameter outlet opening. The nozzle is defined by a nozzle wall that has a constant taper from the inlet opening to the outlet opening.

In a contemplated embodiment of the disclosure, the outer wall of the diffuser tube includes a layer of insulating material. The layer of insulating material applied to the outer surface of the outer wall of the diffuser tube reduces the temperature of the surface over which the fluid being heated passes. The reduced temperature of the outer surface reduces scaling and extends the service life of the injection heater.

For each of the nozzle designs, the individual nozzles can be formed such that the injection axis of the nozzle is angled either upstream or downstream relative to the flow axis of the liquid flowing through the injection heater. Angling the individual nozzles either upstream or downstream can increase the efficiency of the injection heater depending upon the type of fluid being heated.

The individual injection nozzles ferried on the diffuser tube can be positioned in a series of separated injection zones. By separating the nozzle into injection zones, the injection heater can increase the precision of the heated gas injected into the fluid being heated.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION OF THE INVENTION

Figure 1:
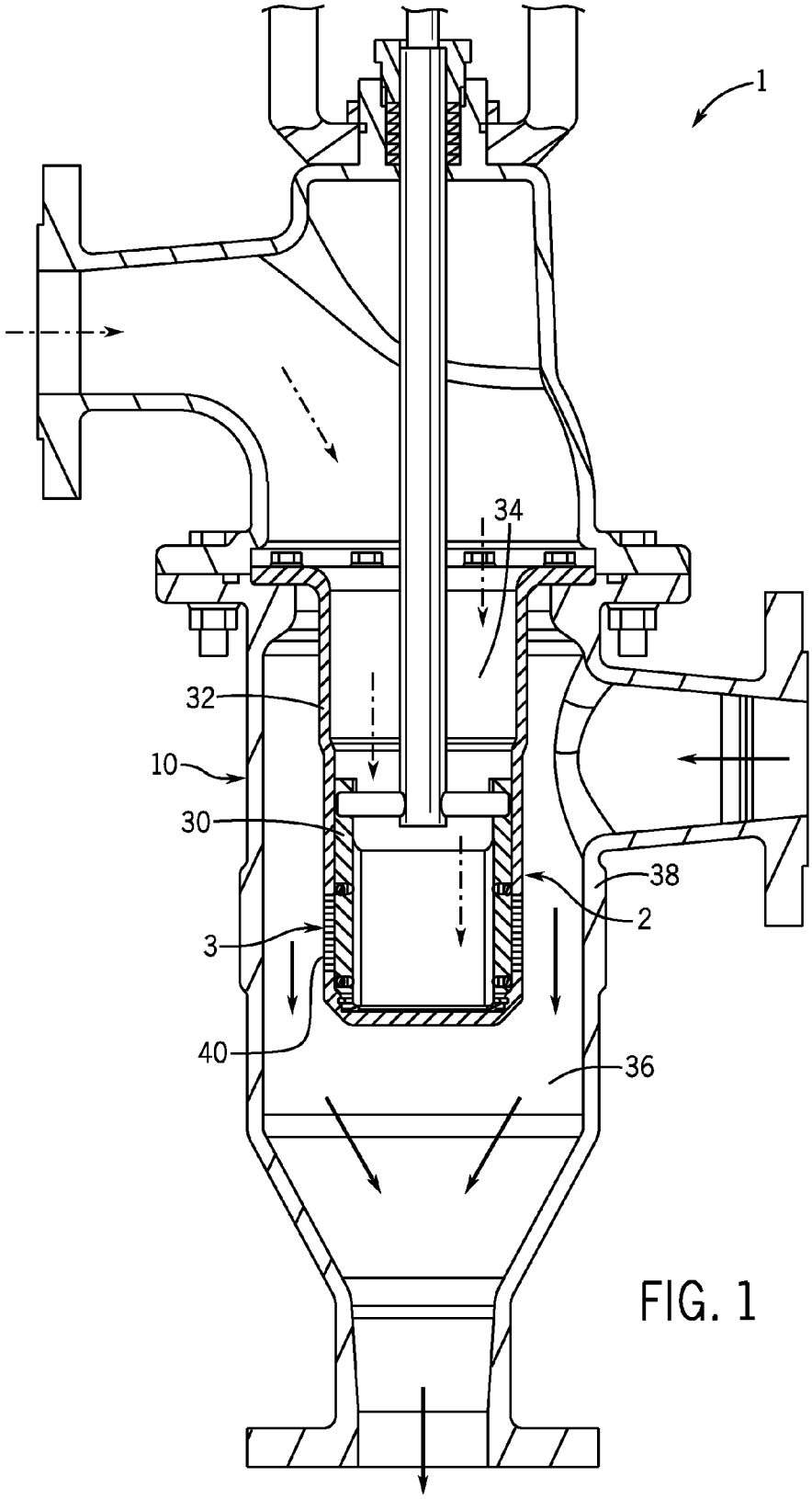
FIG. 1 is a cross sectional view of one possible direct contact steam injection heater in which the nozzles of the present disclosure may be used.

FIG. 1 illustrates a section view of a direct steam injection type heater 1. A diffuser 2 is positioned in the heater 1 such that a process fluid flowing generally axially past the diffuser 2 absorbs heat energy from steam jets exiting the series of nozzles 3. Although the injection heater is described as being useful for injecting steam into a flow of liquid to heat the liquid, other heated gasses other than steam could be used while operating within the scope of the present disclosure. Steam will be utilized in the present disclosure with the understanding that other types of gasses could also be used when applied as a fluid mixing device.

As illustrated in FIG. 1, the heater 1 includes a regulating member 30 that is movable within a diffuser tube 32. In the embodiment illustrated, the regulating member 30 includes a series of seals that expose a variable number of the individual nozzles 3 to control the amount of steam flowing from the open interior 34 of the diffuser tube 32 into the flow of processed fluid contained within the interior 36 of the heater body 38. In the embodiment illustrated in FIG. 1, the series of individual nozzles 3 are contained within a single zone 40. However, in accordance with the present disclosure, as will be described in much greater detail below, the individual nozzles 3 can be grouped differently depending upon the configuration of the diffuser tube 32.

Figure 2:
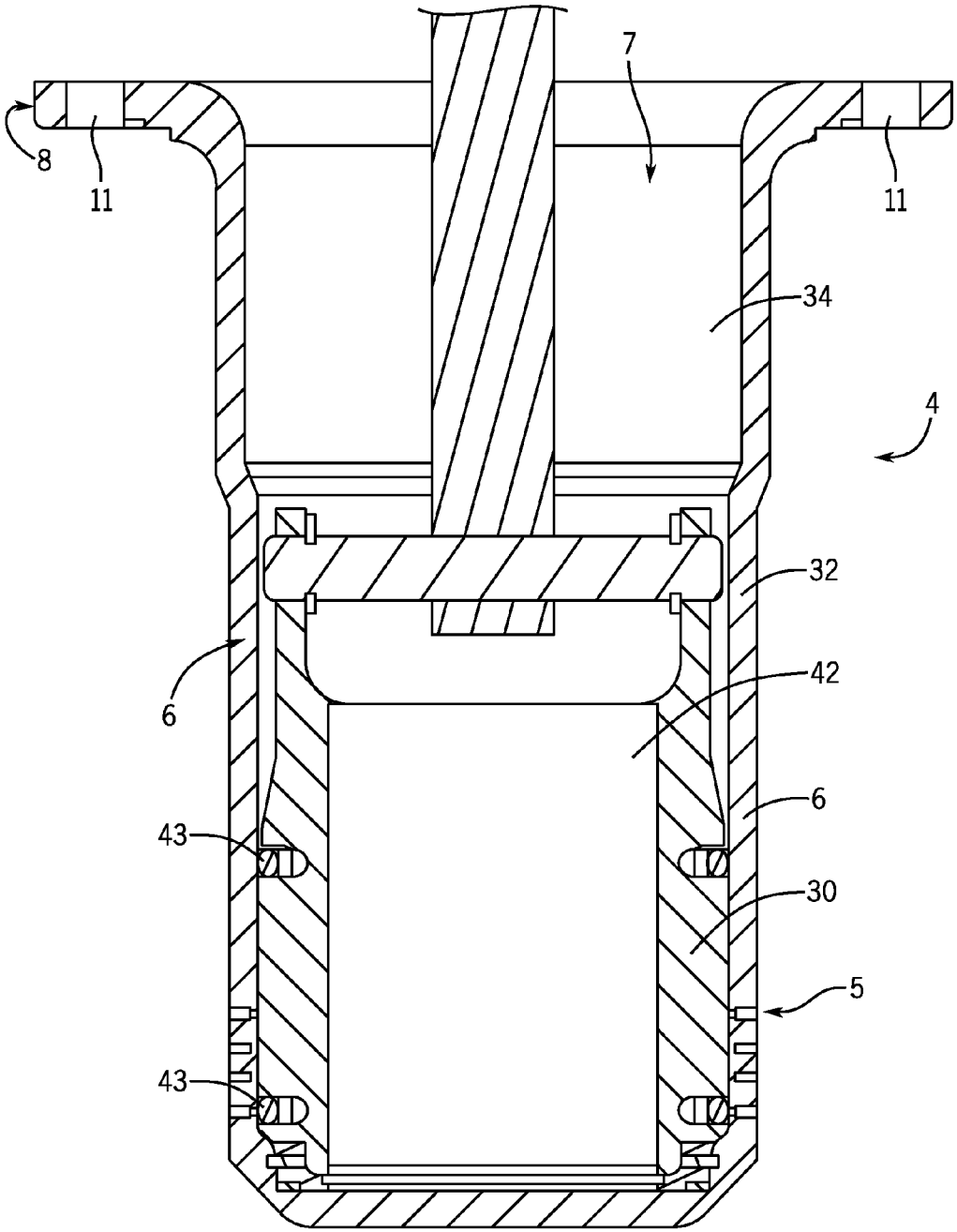
FIG. 2 is a section view of the diffuser design of FIG. 1.

FIG. 2 illustrates a generally cylindrical steam diffuser 4 with a single cluster of nozzles 5 located radially on the outer wall 6. FIG. 2 shows one nozzle configuration of many possible such configurations to be described below. Steam enters through one large steam inlet 7 located at the top of the diffuser tube 32 and flows through the open interior 34. The diffuser tube 32 contains a flange 8 concentric to the main chamber 9 of the diffuser. The purpose of the flange 8 is to locate the diffuser 4 axially inside the fluid body 10 of the heater 1 using mounting holes 11. After entering the diffuser 4, the steam enters an open interior 42 of the regulating member 30. When the regulating member 30 is moved to expose the nozzles 5, the steam exits through the exposed nozzles 5 at substantially higher velocity into the flowing process fluid. Although a pair of seals 43 are shown in the embodiment of FIG. 2 to help control the steam flow, it should be understood that the seals could be eliminated while operating within the scope of the present disclosure.

Figure 3:
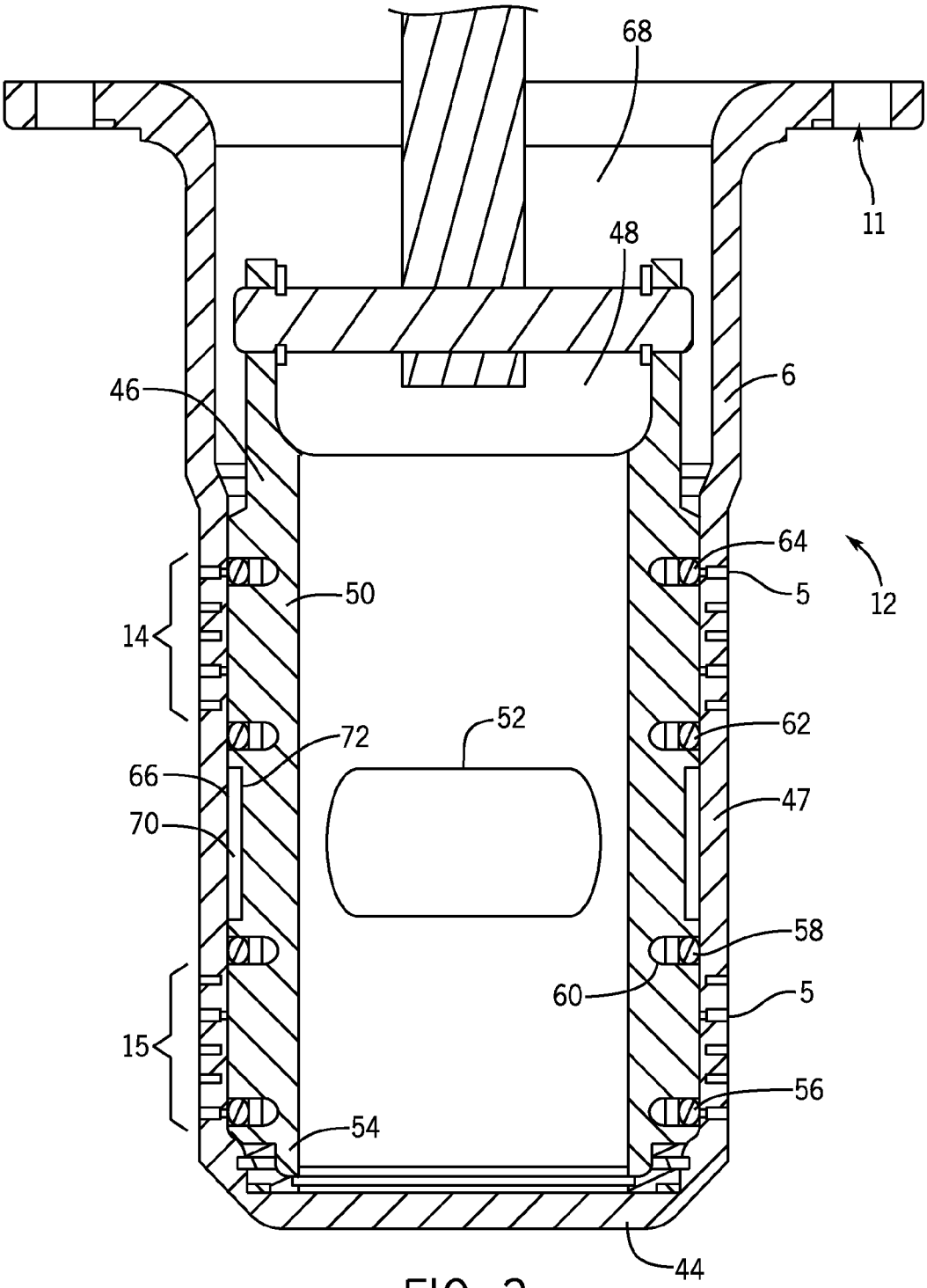
FIG. 3 is a sectional view of an alternate possible diffuser design.

FIG. 3 illustrates yet another alternate embodiment of a steam diffuser 12. In the alternate embodiments shown in FIG. 3, the series of individual nozzles 5 are formed in the outer wall 6 of the diffuser tube 12. The individual nozzles 5 are organized in a pair of zones 14 and 15. The first zone 15 is formed near the bottom end 44 of the diffuser tube 12. The first zone 15 includes a series of individual nozzles positioned in a regular array. The first zone 15 terminates at an upper end. A solid separating wall 47 extends above the first zone 15. The solid wall 47 does not include any nozzles and thus does not allow steam to flow through this portion of the diffuser tube 12.

A second zone 14 is located axially above the solid wall 47 and includes a similar series of nozzles 5. Thus, based upon the movement of the regulating member 46, the individual nozzles contained within the first and second zones 14, 15 are selectively exposed to the flow of steam.

In the embodiment shown in FIG. 3, the regulating member includes an open interior 48 that receives the flow of steam from the heater. The open interior 48 is defined by an outer wall 50 of the regulating member. As illustrated in FIG. 3, the outer wall 50 of the regulating member 46 includes an intermediate steam opening 52. The intermediate steam opening 52 allows steam to flow radially outward from the regulating member and eventually through the exposed nozzles of the second zone 14. The flow regulating member 46 includes an open bottom end 54 that allows an additional portion of the flow of steam to exit the regulating member 46. When the regulating member 46 is moved from the closed condition shown in FIG. 3, a portion of the flow of steam exits through the open end 54 and flows through the exposed nozzles 5 of the first zone 15. At the same time, a portion of the flow of steam exists through the intermediate opening 52 and flows through the exposed nozzles 5 of the second zone 14.

In the embodiment shown in FIG. 3, the regulating member 46 includes a first sealing member 56 and a second sealing member 58 that are spaced from each other. Each of the sealing members 56, 58 are preferably a resilient member retained within a groove 60 formed in an outer surface of the wall 50 defining the open interior 48 of the regulating member 46. As illustrated in FIG. 3, the first and second sealing members 56, 58 are spaced from each other by the height of the first zone 15. As the regulating member 46 moves upward, the first sealing member 56 exposes an increasing number of the nozzles 5 to allow additional steam to pass through the outer wall 6 of the regulating member 46 and into the flow of material passing by the diffuser tube 12. The second sealing member 58 prevents steam from flowing past the second sealing member 58 to aid in controlling the amount of steam discharged from the diffuser tube 12.

A third sealing member 62 and a fourth sealing member 64 are also each contained within corresponding grooves formed in the regulating member 46. The third and fourth sealing members 62, 64 are spaced from each other by the general width of the second zone 14 of nozzles 5. The third sealing member 62 moves along the inner surface 66 of the outer wall 50 of the diffuser tube 12 to selectively expose an increasing number of nozzle openings 5. The fourth sealing member 64 prevents the flow of steam contained within the open interior 68 from reaching the series of nozzles 5.

Although the four sealing members 56, 58, 62 and 64 are shown in the embodiment of FIG. 3, it is contemplated that the sealing members could be eliminated from the regulating member 46. In such an embodiment, the close spacing between the outer wall of the regulating member 46 and the inner wall of the diffuser tube 12 would limit the flow of steam or other gas. Although the use of the multiple sealing members is considered more preferred, the sealing members could be eliminated while operating within the scope of the present disclosure.

As described above, when the regulating member 46 moves upward, the steam flowing through the intermediate steam opening 52 flows into the gap 70 formed between the inner surface 66 of the diffuser tube and a recess 72 created within the outer wall 50 of the regulating member 46.

The pair of zones 14, 15 allows for steam to be discharged from the diffuser tube 12 at different locations. The configuration of each of the zones 14, 15 could be modified depending upon the desired heating characteristics for the diffuser tube 12. Additionally, the spacing of the individual nozzles 5 could be varied depending upon the desired amount of control needed for the diffuser tube 12. As an illustrative example, the individual nozzles 5 could be created having various different sizes and configurations as well as being spaced from each other by varying amounts to control the flow of steam out of the diffuser tube 12. Further, although two zones 14, 15 are shown in the embodiment of FIG. 3, it is contemplated that additional zones could be utilized while operating within the scope of the present disclosure. One distinct advantage of separating the nozzles into multiple zones is to separate and space the flow of steam from the nozzles, along the length of the diffuser tube 12. The spacing between the zones will aid to increase the capacity of the diffuser and to increase its effectiveness by separating the heating capacity of each of the nozzles. When the nozzles are separated into multiple zones as shown in FIG. 3, the flow of steam from each of the nozzles does not impinge on each other, thereby increasing condensation effectiveness.

Although various different types of steam diffusers are shown in FIGS. 1-3 that include some type of internal modulation, it is contemplated that the individual nozzle designs to be described below could be utilized in different types of heaters or mixers. As an example, the nozzle designs to be described below could be used with various different types of steam injection heaters that do not include any type of modulation but rather utilize steam pressure modulation to control the amount of heating. In a direct steam injection heater that does not include internal modulation, the amount of steam injected into the liquid being heated is controlled by the pressure and supply of steam into an injection tube. The nozzle designs of the present disclosure can be utilized as part of the injection tube to further improve the introduction of heated gas into the liquid flow.

Throughout the present disclosure, the injection of a heated gas into a flow of an unheated liquid is commonly referred to as the injection of steam. However, it should be understood that other types of gases could be injected into the fluid stream. As an example, heated ozone, nitrous, air or other gases could be utilized while operating within the scope of the present disclosure.

Figure 4:
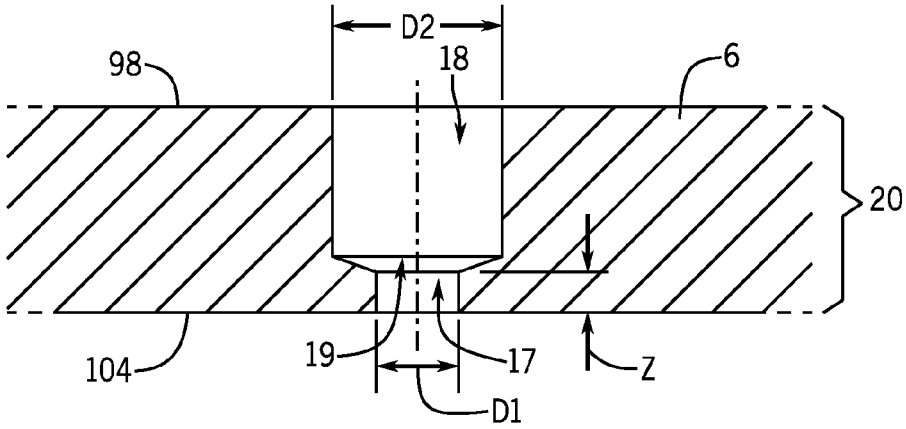
FIG. 4 is a section view of one nozzle design.

FIG. 4 illustrates one possible nozzle design with the purpose of stabilizing the steam jet under conditions which may cause instability in the standard straight walled nozzle. This design is characterized by two coaxial cylinders. The first is a small cylinder 17 open to the inner surface 104 of the outer wall 6 with diameter D1 and the second is a large cylinder 18 open to the outer surface 98 of the outer wall 6 with diameter D2 and a truncated cone 19 that defines a transition zone connecting the cylinders. Diameter D1 should be between 0.030 inches to 0.25 inches. The ratio of the large diameter to the small diameter should be no less than 1.25 and should not be greater than 3.0. The ratio of the hole length 20 and the diameter of the small cylinder 17 should be no less than 2.0 and no more than 5.0. In addition, the ratio of the hole length Z to the diameter D1 should be less than 1.25.

Figure 5:
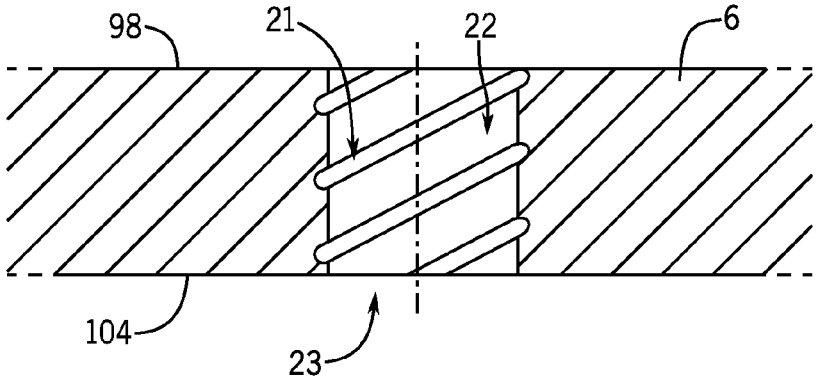
FIG. 5 is a section view of an alternate nozzle design.

FIG. 5 illustrates an alternate nozzle design 23 with the purpose of stabilizing the steam jet. This nozzle 23 is characterized by one or more spiral grooves 21 in the wall 22 of the generally cylindrically nozzle 23. The spiral groove 21 gives the steam a spiraling momentum which increases the stability of the steam as it exits the diffuser 12.

Figure 6:
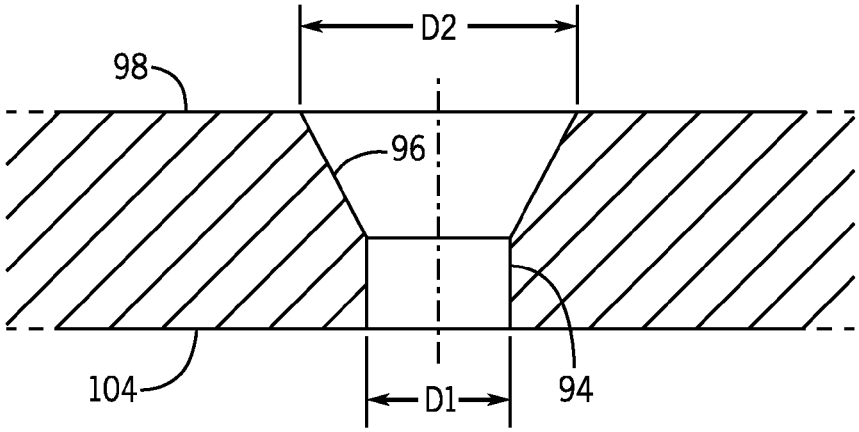
FIG. 6 is a section view of another alternate nozzle design.

FIG. 6 illustrates another alternate nozzle design with the purpose of stabilizing the steam jet. The nozzle shown in FIG. 6 is characterized by a small cylinder 94 having a constant diameter D1. The small cylinder 94 transitions into a cone 96 which extends from the small cylinder 94 to the outer surface 98. The cone 96 has an outlet diameter D2 that is greater than the inlet diameter D1.

Figure 7:
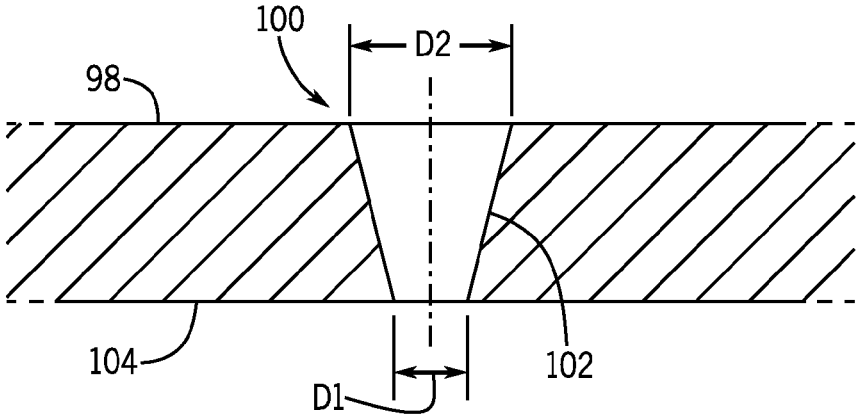
FIG. 7 is a section view of another alternate nozzle design.

FIG. 7 illustrates yet another alternate nozzle design. In the alternate nozzle design shown in FIG. 7, the nozzle 100 is characterized by a nozzle wall 102 that tapers from the inner surface 104 to the outer surface 98. The relative angle of the nozzle wall 100 can be varied depending upon the desired flow characteristics. However, the inlet diameter D1 is less than the outlet diameter D2.

Figure 8:
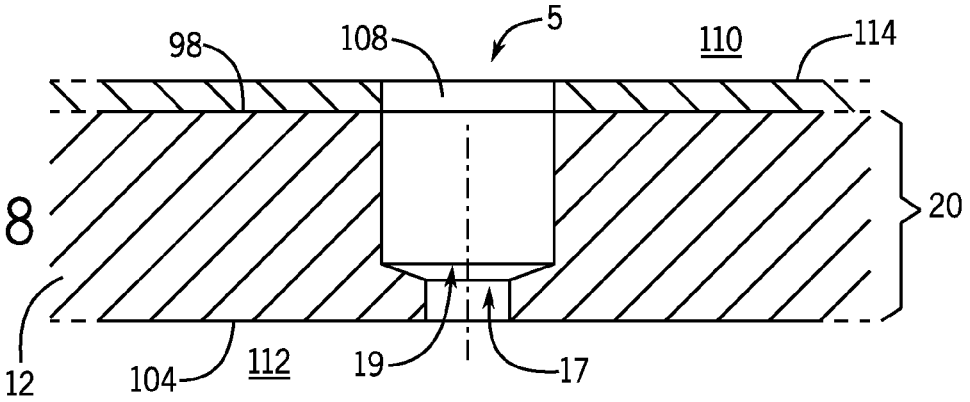
FIG. 8 is a section view illustrating a layer of plastic material attached to the outer surface of the diffuser.

FIG. 8 illustrates an additional configuration for the diffuser tube 12. In the embodiment illustrated in FIG. 8, a layer of insulating material 106 is applied to the outer surface 98 of the diffuser tube. The layer of insulating material 106 is formed on the outer surface 98 of the diffuser tube 12 before the individual nozzles 5 are formed in the tube 12. After the layer of insulating material 106 is formed, each of the nozzles 5 is formed by drilling. The drilling process creates a hole 108 in the insulating material aligned with the nozzle 5 formed in the diffuser tube 12. The layer of insulating, material is utilized as a layer of insulation between the flow of material to the exterior of the diffuser tube, as shown by reference numeral 110, and the flow of steam in the area indicated by reference numeral 112. In the contemplated embodiment of the disclosure, the layer of insulating material 106 is plastic, although other materials are contemplated. The insulative properties of the layer of plastic 106 reduce the temperature of the outer surface 114 of the insulative material 106, which minimizes the effect of scale or mineral buildup, especially in hard water applications. In embodiments not including the layer of insulative material 106, scale tends to build up across the nozzle opening, which can dramatically affect the flow of the steam or other liquid being introduced through the series of nozzles 5. The specific material selected for the layer of insulative material 106 can vary depending upon whether greater insulation is needed or whether the material needs to have increased durability. The level of durability needed will depend upon the type of liquid passing over the exterior of the diffuser tube. The hardness of the plastic material can be selected based upon the type of liquid passing over the diffuser tube to enhance durability.

Although not shown in FIG. 8, it is also contemplated that instead of utilizing the layer of plastic material 107, the outer surface 98 of the diffuser tube 12 can include a highly polished surface. The highly polished surface also acts to minimize the scaled minerals since attachment to the outside surface of the highly polished diffuser tube will be more difficult than an unpolished surface.

Figure 9:
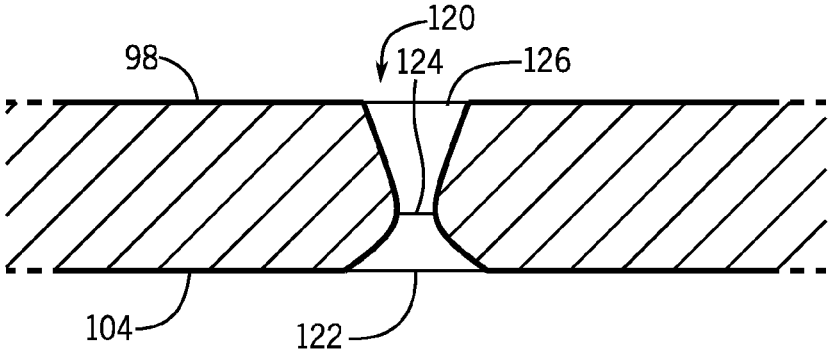
FIG. 9 is a section view of another alternate nozzle design.

FIG. 9 illustrates another alternate nozzle design. In the embodiment shown in FIG. 9, the nozzle 120 is characterized as having, a smooth entry and exit region with a contraction therebetween. In the embodiment shown in FIG. 9, the entry diameter 122 is at least two times the contraction diameter 124 and can be larger to provide smooth entry. The exit diameter 126 must be larger than the contraction diameter 124. The maximum angle between the contraction diameter 124 and the exit diameter 126 must be no larger than 70° to prevent flow from detaching.

In the embodiment shown in the Figures for the various different nozzle designs, each of the nozzles is positioned along an injection axis that is generally perpendicular to the longitudinal axis of the diffuser tube. In an embodiment in which the flow axis of the liquid being heated is parallel to the longitudinal axis of the diffuser tube, the injection axis is perpendicular to the flow axis of the liquid passing through the injection heater.

Figure 10:
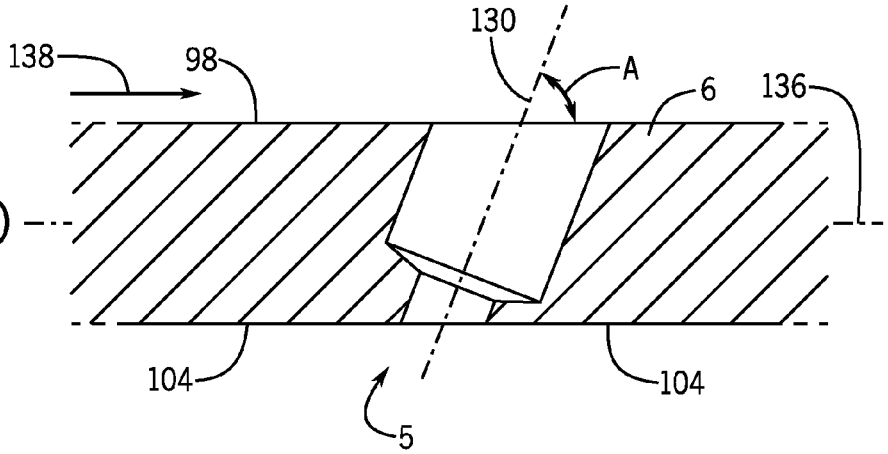
FIG. 10 is a section view illustrating a nozzle angled in a downstream direction.

FIG. 10 illustrates an embodiment in which the injection axis 130 of the nozzle 5 is positioned at an angle relative to the longitudinal axis 132 of the outer wall 6. The longitudinal axis 136 of the outer wall 6 is generally parallel to the flow axis 138 of the fluid being heated. The angle A directs the flow of heated gas from the nozzle 5 in a downstream direction. The angle A can be varied depending upon the desired mixing characteristics as well as the types of liquid being heated.

Figure 11:
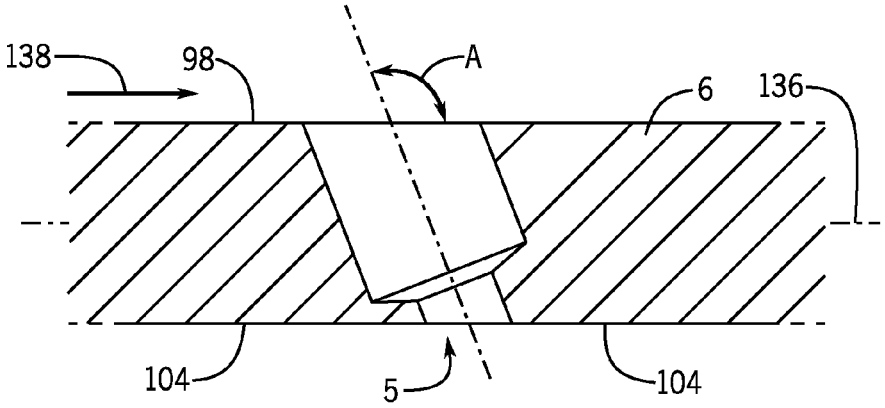
FIG. 11 is a section view illustrating a nozzle angled in an upstream direction.

FIG. 11 illustrates a similar embodiment in which the nozzle 5 is angled to direct the heated gas in an upstream direction. Once again, the angle A can be varied depending upon the mixing requirements and the types of liquid being heated.

Although one of the specific nozzle designs is shown in the embodiment of FIGS. 10 and 11, it should be understood that each of the nozzle designs shown in the drawing Figures could be angled either in an upstream or downstream direction, as illustrated in FIGS. 10 and 11.

Figure 12:
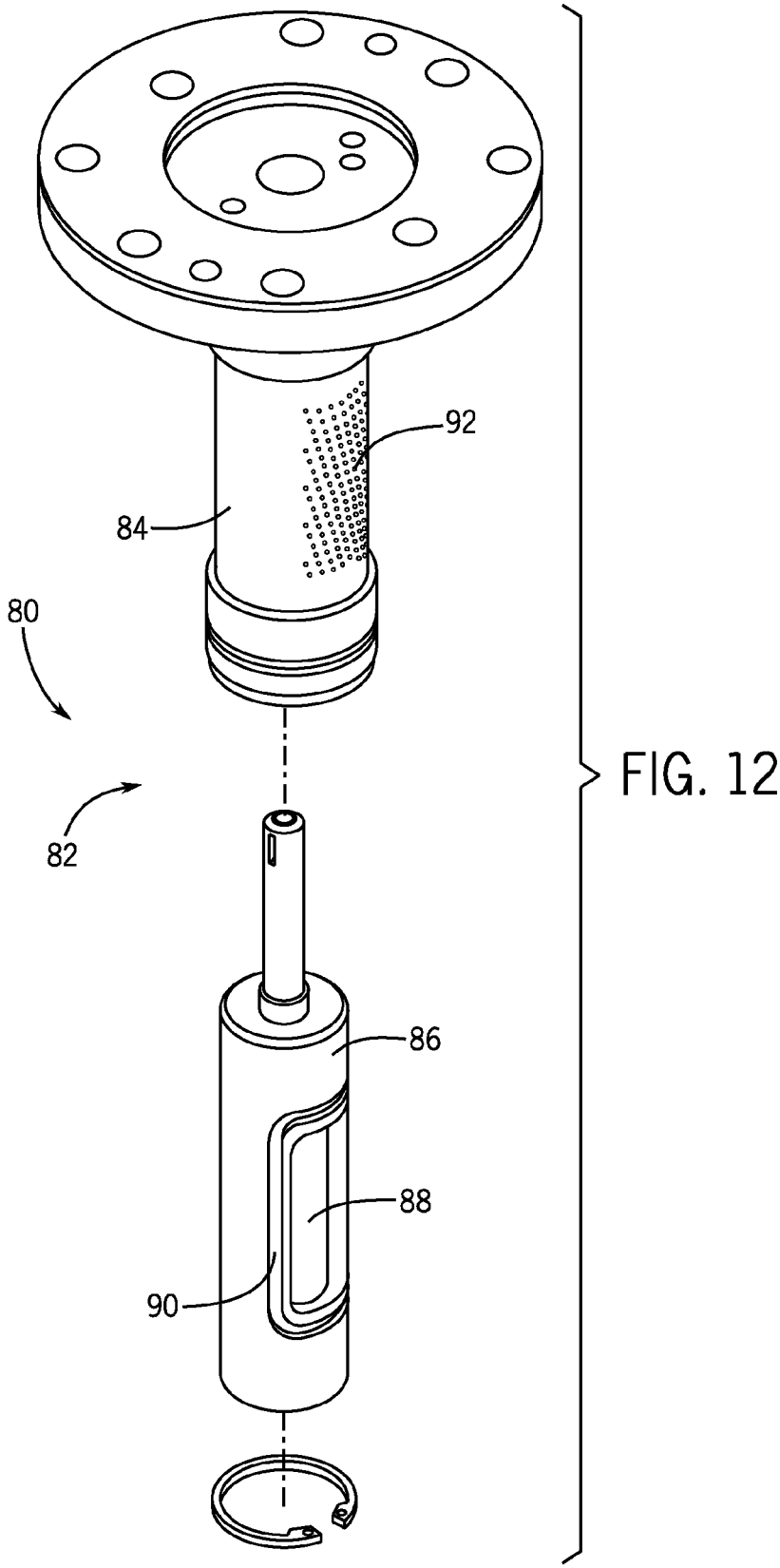
FIG. 12 is an exploded view of another type of direct contact steam injection heater that can utilize the nozzle of the present disclosure.

FIG. 12 illustrates one of many other types of steam injection heaters 80 that can utilize the nozzle design described above. In the embodiment shown in FIG. 9, the steam injection heater includes a diffuser assembly 82 that includes a cover 84 and a regulating member 86. Steam flows into the regulating member 86 and is allowed to exit the regulating member through one of a pair of openings 88. The opening 88 is surrounded by a sealing member 90. As the regulating member 86 rotate within the cover 84, the sealing member 90 exposes an increasing number of nozzles 92 formed in the outer surface of the cover 84. Each of the individual nozzles can be configured as shown in FIGS. 4-5. Additionally, the configuration of the individual nozzles 92 within the cover 84 can be selected based upon the desired amount of steam discharged from the steam injection heater 80.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. An injection heater for introducing a heated gas into a fluid stream for heating the fluid stream, comprising:

a diffuser tube having an outer wall including an inner surface and an outer surface, wherein the outer wall defines an open interior that receives the heated gas; and a plurality of nozzles spaced along the outer wall of the diffuser tube to direct the heated gas out of the open interior and into the fluid stream flowing over the outer wall, wherein each of the nozzles includes a first cylinder having a constant first diameter including an inlet opening having the first diameter and open to the inner surface of the outer wall and a second cylinder having a constant second diameter including an outlet opening having the second diameter open to the outer surface of the outer wall wherein the first and second cylinders are joined to each other by a conical transition zone and wherein the second diameter is greater than the first diameter.

2. The injection heater of claim 1 wherein the ratio of the first diameter to the second diameter is in the range of 1.25 to 3.0.

3. The injection heater of claim 2 wherein the first cylinder has a height selected such that the ratio of the thickness of the outer wall to the height of the first cylinder is in the range of 2.0 to 5.0.

4. The injection heater of claim 3 wherein the ratio of the height of the first cylinder to the first diameter is less than 1.25.

5. The injection heater of claim 1 wherein each of the nozzles extends along an injection axis, wherein the infection axis is positioned at an angle other than 90° relative to a longitudinal axis of the diffuser tube.

6. The injection heater of claim 5 wherein the nozzles are angled upstream relative to a flow axis of the liquid being heated.

7. The injection heater of claim 5 wherein the nozzles are angled downstream relative to a flow axis of the liquid being heated.

8. An injection heater for introducing a heated gas into a fluid stream for heating the fluid stream, comprising:

a diffuser tube having an outer wall including an inner surface and an outer surface, wherein the outer wall defines an open interior that receives the heated gas; and a plurality of nozzles spaced along the outer wall of the diffuser tube to direct the heated gas out of the open interior and into the fluid stream flowing over the outer wall, wherein each of the nozzles includes a first cylinder having a constant first diameter including an inlet opening having the first diameter and open to the inner surface of the outer wall and a conical section extending from the first cylinder to the outer surface of the outer wall to define an outlet opening having a second diameter open to the outer surface of the outer wall, wherein the second diameter is greater than the first diameter.

9. An injection heater for introducing a heated gas into a fluid stream for heating the fluid stream, comprising:

a diffuser tube having an outer wall including an inner surface and an outer surface, wherein the outer wall defines an open interior that receives the heated gas;

a plurality of nozzles spaced along the outer wall of the diffuser tube to direct the heated gas out of the open interior and into the fluid stream flowing over the outer wall; and, a layer of insulating material applied to the outer surface of the outer wall of the diffuser tube, wherein each of the nozzles includes an inlet opening having a first diameter and open to the inner surface of the outer wall and an outlet opening having a second diameter open to the outer surface of the outer wall, wherein the second diameter is greater than the first diameter.

10. The injection heater of claim 9 wherein the insulating material is plastic.

11. An injection heater for introducing a heated gas into a fluid stream for heating the fluid stream, comprising:

a diffuser tube having an outer wall including an inner surface and an outer surface, wherein the outer wall defines an open interior that receives the heated gas;

a first injection zone and a second injection zone positioned along the outer wall of the diffuser tube and separated from each other; and a plurality of nozzles positioned in each of the first and second injection zones along the outer wall of the diffuser tube to direct the heated gas out of the open interior and into the fluid stream flowing over the outer wall, wherein each of the nozzles includes a first cylinder having a constant first diameter and an inlet opening having the first diameter and open to the inner surface of the outer wall and a second cylinder having a constant second diameter and an outlet opening having a second diameter open to the outer surface of the outer wall, wherein the first and second cylinders are joined to each other by a conical transition zone and the second diameter is greater than the first diameter.

12. The injection heater of claim 11 wherein each of the nozzles extends along an injection axis, wherein the injection axis is positioned at an angle other than 90° relative to a longitudinal axis of the diffuser tube.

13. The injection heater of claim 12 wherein the nozzles are angled upstream relative to a flow axis of the liquid being heated.

14. The injection heater of claim 12 wherein the nozzles are angled downstream relative to the flow axis of the liquid being heated.

15. The injection heater of claim 11 wherein the ratio of the first diameter to the second diameter is in the range of 1.25 to 3.0 and the ratio of the thickness of the outer wall to the height of the first cylinder is in the range of 2.0 to 5.0.

16. An injection heater for introducing a heated gas into a fluid stream for heating the fluid stream, comprising:

a diffuser tube having an outer wall including an inner surface and an outer surface, wherein the outer wall defines an open interior that receives the heated gas;

a first injection zone and a second injection zone positioned along the outer wall of the diffuser tube and separated from each other;

a plurality of nozzles positioned in each of the first and second injection zones along the outer wall of the diffuser tube to direct the heated gas out of the open interior and into the fluid stream flowing over the outer wall; and a layer of insulating material applied to the outer surface of the outer wall of the diffuser tube, wherein each of the nozzles includes an inlet opening having a first diameter and open to the inner surface of the outer wall and an outlet opening having a second diameter open to the outer surface of the outer wall, wherein the second diameter is greater than the first diameter.

17. The injection heater of claim 16 wherein the insulating material is plastic.

* * * * *